US005103537A

United States Patent [19]

Snyder et al.

[11] Patent Number: 5,103,537

[45] Date of Patent: Apr. 14, 1992

[54] STRAP FASTENER ASSEMBLY

[75] Inventors: William A. Snyder, Sierra Vista; Mark L. Angier, Tucson; Anthony C. Mulligan, Tucson; Donald R. Uhlmann, Tucson, all of Ariz.

[73] Assignee: Pet Affairs Inc., Tucson, Ariz.

[21] Appl. No.: 651,976

[22] Filed: Feb. 7, 1991

[51] Int. Cl.[5] ..... A44B 11/25

[52] U.S. Cl. ..... 24/198; 24/265 R; 24/701

[58] Field of Search ..... 24/265 R, 265 C, 265 BC, 24/265 EC, 265 H. 307, 701, 308, 198, 309, 200, 323, 129 B, 128

[56] References Cited

U.S. PATENT DOCUMENTS

| | | | |
|---|---|---|---|
| 849,282 | 4/1907 | Stukenborg | 24/265 R X |
| 2,996,228 | 8/1961 | Bauman . | |
| 3,480,325 | 11/1969 | Kramer . | |
| 3,510,151 | 5/1970 | Weman . | |
| 4,035,877 | 7/1977 | Brownson et al. . | |
| 4,171,555 | 10/1979 | Bakker et al. . | |
| 4,273,215 | 6/1981 | Leggett . | |
| 4,416,319 | 11/1983 | Hofmann | 24/701 X |
| 4,941,434 | 7/1990 | Ellwanger | 24/265 BC X |
| 5,025,534 | 6/1991 | Meijer | 24/200 X |

FOREIGN PATENT DOCUMENTS

| | | | |
|---|---|---|---|
| 1069214 | 7/1954 | France | 24/701 |

*Primary Examiner*—James R. Brittain

*Attorney, Agent, or Firm*—Fitzpatrick, Cella, Harper & Scinto

[57] ABSTRACT

A strap fastener assembly which comprises a flat rigid plate-like member and a flexible strap. The plate-like member has an opening extending therethrough in the form of two elongated slots which intersect with each other to form an acute angle. One of the slots is wider than the other. The strap has a thickened portion which prevents it from being pulled through the slot of lesser width but on movement of the strap to the other slot, its thickened portion can be pulled through that other slot.

7 Claims, 1 Drawing Sheet

STRAP FASTENER ASSEMBLY

BACKGROUND OF THE INVENTION

1. Field of the Invention

This invention relates to strap fasteners and in particular it concerns a novel strap fastener assembly which is simple in construction, easy to use and reliable. An alternative arrangement is also described in which the end of the strap is looped through a plurality of slots in the insert.

2. Description of the Related Art

United States patent application Ser. No. 07/562,670, filed Aug. 3, 1990, describes a pet restraining apparatus capable of restraining a pet, such as a dog, in a vehicle by making use of the vehicle's seat belt system. The pet restraining apparatus comprises a harness which fits onto the pet, and a flexible strap extending from the harness. At the end of the strap is a plate-like insert which snaps into the receptacle portion of an automobile seat belt. The insert is attached to the strap by looping the strap end through a slot in the insert and then sewing the end back onto the strap.

Since there are many styles and sizes of automobile seat belt buckles, it is necessary to provide several different buckle inserts with the restraining apparatus. Therefore there is a need to have a strap fastener assembly comprising a plate-like member and a flexible strap wherein the member is held securely to the strap but can easily be removed and replaced with another member.

SUMMARY OF THE INVENTION

The present invention comprises a novel strap fastener assembly which provides a secure attachment between a flexible strap and a rigid plate-like member and yet allows the member to be removed from the strap with ease. According to the invention, the rigid plate-like member has an opening extending through it with the opening being in the form of two elongated slots which intersect to form an angle, and a flexible strap extending through and closely fitting within the opening. The two elongated slots are each long enough to accommodate the width of the strap and one slot is wider than the other. The strap in turn has a thickened portion which can be passed through the wider slot but not through the narrower slot. When the strap extends through the narrower slot, the thickened portion prevents the strap from being pulled through the slot and thereby securely holds the plate-like member to the strap. However, by flexing the strap across its width, it may be moved through the angle between the slots and brought into the wider slot. In this position, the strap can easily be removed from the plate-like member by pulling the thickened portion through the wider slot.

DETAILED DESCRIPTION OF THE PREFERRED EMBODIMENT

Figure 1:
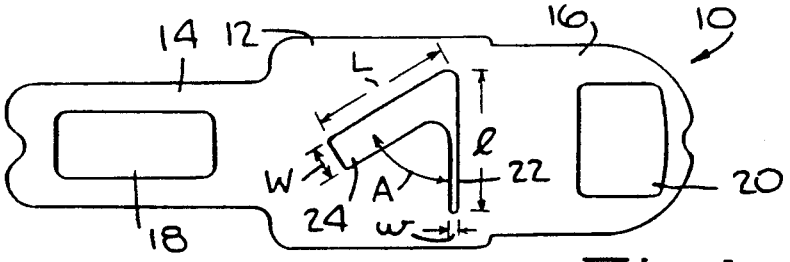
FIG. 1 is a plan view of a buckle insert which can be used as one member of a fastener assembly according to the invention.

An insert member 10, as shown in FIG. 1, is made of a flat, generally rectangular, plate of solid material such as 0.125 inch (3.17 mm) thick steel. The insert member 10 has a central portion 12 and left and right end portions 14 and 16 respectively. The end portions are of a size and shape that permits them to fit into the receptacle portions (not shown) of different automobile seat belt buckles; and these end portions are formed with associated locking holes 18 and 20 which permits them to become locked in the buckle receptacle portion of such seat belt buckles.

The central portion 12 of the insert member 10 is formed with an opening formed of two elongated slots 22 and 24 which intersect to form an acute angle A. The first slot 22 extends transversely of the longitudinal dimension of the insert member i.e., transversely of the direction of pull on the insert member 10 from a buckle assembly; and the second slot 24 extends generally diagonally across the central portion 12 of the insert member. The slots 22 and 24 have lengths l and L, respectively, which are about equal. The slots 22 and 24 also have widths w and W, respectively; however, the width W of the second slot 24 is substantially greater than the width w of the first slot 22.

Figure 2:
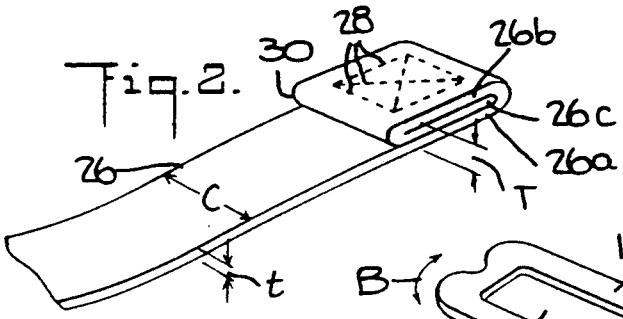
FIG. 2 is a perspective view of a flexible strap which can be used as the other member of a strap fastener assembly according to the present invention.

FIG. 2 shows the end portion of a length of the flexible strap 26 to which the insert member 10 is to be attached. The strap 26 may be made of nearly any flexible material that has substantial tensile strength. In the preferred embodiment the strap 26 is made of nylon webbing. The end of the strap 26 is looped back on itself to form three layers 26*a*, 26*b* and 26*c*. These layers are sewn together as shown at 28 to form a thickened portion 30 which is substantially thicker that the remainder of the strap 26. The strap 26 has a transverse or cross dimension C which is only slightly less than the length l and L of the insert member slots 22 and 24. The main portion of the strap has a thickness dimension t which is only slightly less than the width w of the first slot 22. The thickened portion 30 of the strap 26 has a thickness dimension T which is greater than the width w of the first insert member slot 22 but somewhat less than the width W of the second insert member slot 24.

In the preferred embodiment shown herein, the strap 26 has a thickness t of 0.625 inches (1.59 mm) and a transverse dimension C of 0.75 inches (1.9 cm). The first slot 22 in the plate 10 has a length l of one inch (2.54 cm) and a width w of 0.94 inches (2.38 mm). The second slot 24 in the plate 10 has a length l of one inch (2.54 cm) and a width W of 0.31 inches (7.94 mm). The angle A between the slots 22 and 24 is about 60°.

Figure 3:
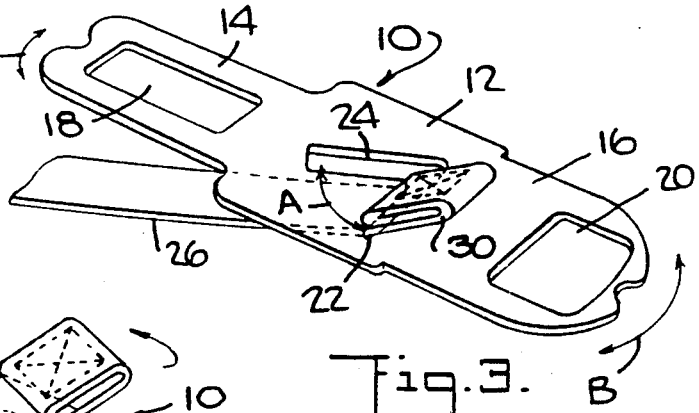
FIG. 3 is a perspective view of a strap fastener assembly embodying the present invention and comprising an insert member secured to a flexible strap.

FIG. 3 shows the insert member 10 locked to the strap 26. As can be seen, the main portion of the strap 26 passes through the narrow slot 22 but because of the thickness T of the thickened portion 30, it cannot pass through the slot and the insert member 10 is solidly locked to the strap. Furthermore, this locking remains effective even when the insert member 10 is pivoted, as indicated by the arrows B to bring either its end portion 14 or its end portion 16 into a position projecting out from the end of the strap. Thus, the versatility of the insert member, which permits it to accommodate many different types and sizes of automobile seat belt buckles, is preserved.

Figure 4:
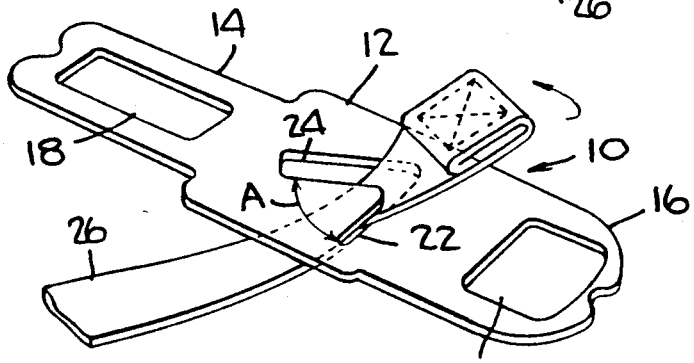
FIG. 4 is a view similar to FIG. 3 but showing the strap during movement thereof toward a releasable position relative to the insert member.
Figure 5:
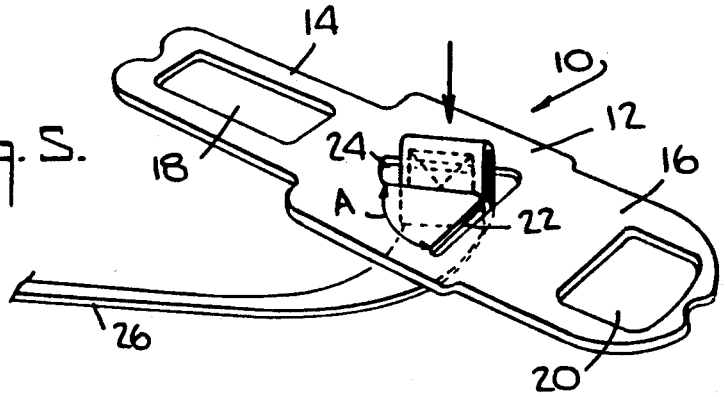
FIG. 5 is a view similar to FIGS. 3 and 4 and showing the strap fully moved to its releasable position relative to the insert member.

When it is desired to remove the insert member 10 from the strap 26, the strap is moved so that its thickened portion is away from the slots 22 and 24 as shown in FIG. 4. The strap 26 is then flexed across its width and is moved around the angle A between the slots and into the wider slot 24. When the strap 26 is fully in position in the wider slot 24, its thickened portion 30 passes through the slot 24 as shown in FIG. 5 so that the insert member 10 may be removed from the strap 26.

It will be appreciated that when the strap 26 is in the locking position as shown in FIG. 3, the thickened portion 30 prevents the strap from being bent across its width. Therefore, while the strap 26 is pulling on the insert member 10, the strap cannot bend around the angle A and therefore cannot be brought into the wider slot 24.

There has thus been described a novel strap fastening assembly which is simple in construction, easy to use and reliable.

We claim:

1. A strap fastener assembly comprising a rigid plate-like member having an opening extending through it with the opening being in the form of two elongated slots which intersect to form an angle, the two slots having different widths, and a flexible strap of substantially uniform width extending through and closely fitting within the slot of lesser width, said strap having a thickened portion which cannot pass through the slot of lesser width but can pass through the slot of greater width, whereby the strap is locked to the plate-like member when it is in the narrower slot but can be released from the fastener element by flexing it along its width and moving it to the wider slot.

2. A strap fastener assembly according to claim 1 wherein said slots form an acute angle.

3. A strap fastener assembly according to claim 1 wherein said slots are each essentially of the same length as the transverse dimension of the strap.

4. A strap fastener assembly according to claim 1 wherein said strap is a fabric material and wherein said thickened portion is formed by folding a length of the strap back upon itself and securing said length to the strap.

5. A strap fastener assembly according to claim 1 wherein said plate-like member is an insert portion of a buckle assembly.

6. A strap fastener assembly according to claim 5 wherein said slots are formed in a central region of said plate-like member and wherein the end regions of said plate-like member are shaped to be inserted into and locked with different types of buckle assemblies.

7. A strap fastener assembly according to claim 5 wherein said slot of lesser width extends in a direction transverse to the direction of pull on the plate-like member from a buckle assembly.

* * * * *

UNITED STATES PATENT AND TRADEMARK OFFICE

CERTIFICATE OF CORRECTION

PATENT NO. : 5,103,537

DATED : April 14, 1992

INVENTOR(S) : WILLIAM A. SNYDER ET AL.

It is certified that error appears in the above-identified patent and that said Letters Patent is hereby corrected as shown below:

COLUMN 2

Line 42, "that" should read --than--.
Line 53, "0.625 inches (1.59 mm)" should read --0.0625 inches (1.59 mm)--.
Line 56, "0.94 inches (2.38 mm)." should read --0.094 inches (2.38 mm).--.

Signed and Sealed this

Sixth Day of July, 1993

Michael K. Kirk

MICHAEL K. KIRK

*Acting Commissioner of Patents and Trademarks*

*Attest:*

*Attesting Officer*